US007377314B2

(12) United States Patent
Gonzalez

(10) Patent No.: US 7,377,314 B2
(45) Date of Patent: May 27, 2008

(54) DOWNHOLE GAS SEPARATOR

(75) Inventor: Pedro Gonzalez, Mironda (VE)

(73) Assignee: Intevep, S.A., Caracas (VE)

( * ) Notice: Subject to any disclaimer, the term of this patent is extended or adjusted under 35 U.S.C. 154(b) by 248 days.

(21) Appl. No.: 11/290,941

(22) Filed: Nov. 29, 2005

(65) Prior Publication Data

US 2007/0119588 A1 May 31, 2007

(51) Int. Cl.
*E21B 43/38* (2006.01)

(52) U.S. Cl. ..... 166/105.5

(58) Field of Classification Search ..... 166/265, 166/105.5, 372
See application file for complete search history.

(56) References Cited

U.S. PATENT DOCUMENTS 2,517,198 A * 8/1950 Gilbert ..... 166/105.5
2,748,719 A * 6/1956 Wells ..... 166/105.5
3,556,219 A * 1/1971 Meldau ..... 166/278
5,653,286 A * 8/1997 McCoy et al. ..... 166/105.5
5,711,374 A * 1/1998 Kjos ..... 166/265
6,228,146 B1 * 5/2001 Kuespert ..... 95/46

FOREIGN PATENT DOCUMENTS

CA 2164 11/1996

* cited by examiner

*Primary Examiner*—Jennifer H. Gay
*Assistant Examiner*—Robert E Fuller
(74) *Attorney, Agent, or Firm*—Bachman & LaPointe, P.C.

(57) ABSTRACT

A downhole gas separator includes an external tube having a closed bottom and an open top; and an internal tube positioned eccentrically within the external tube and having an open bottom and a top adapted for connection to a production tube. The internal tube can alternatively be connected to a pump intake. The separator is positioned eccentrically within a casing, and provides for separation of gas from produced fluids before the fluids enter the production tube and/or pump.

18 Claims, 2 Drawing Sheets

DOWNHOLE GAS SEPARATOR

BACKGROUND OF THE INVENTION

The invention relates to a downhole gas separator which is useful in separating gas from produced fluid in a subterranean producing well, especially a well which produces hydrocarbons.

Hydrocarbons fluids are obtained from subterranean formations through production wells as is known to a person of skill in the art. A production tube is communicated through a well to receive fluids from the formation, and these fluids flow upwardly through the production tube to surface storage, refining, treatment and/or further transportation facilities.

It is frequently necessary or desirable to utilize a pump to enhance flow rate through the well. Unfortunately, produced fluids when they first enter the hydrocarbon producing well typically have a large amount of entrained gas, and this gas presents difficulty to the pump. Downhole separators are known and are used to separate gas before the fluids enter the pump. One example of a known downhole separator is as is disclosed in Canadian Patent Number 2,164,145 to McCoy et al. The device of McCoy et al. provides some gas separation and is therefore useful. However, it is desirable to provide even better downhole separation of gas.

It is therefore the primary object of the present invention to provide improved downhole separation.

It is a further object of the invention to provide such improved separation with an apparatus which is simple and reliable in manufacture, installation and use.

Other objects and advantages will appear hereinbelow.

SUMMARY OF THE INVENTION

In accordance with the present invention, the foregoing objects and advantages have been readily attained.

According to the invention, a downhole gas separator is provided which comprises an external tube having a closed bottom and an open top; and an internal tube positioned eccentrically within the external tube and having an open bottom and a top adapted for connection to a production tube. Positioning of the internal tube within the external tube helps to concentrate liquid in the area entering the production tube, and to concentrate gas in an area passing outside of the production tube.

In further accordance with the invention, a downhole gas separator is provided for a production tube positioned within a casing which receives a flow of production fluid comprising gas and liquid, wherein the separator comprises an external tube having a closed bottom and an open top, the external tube being positioned eccentrically within the casing; and an internal tube positioned eccentrically within the external tube and having an open bottom and a top adaptation connection to the production tube.

BRIEF DESCRIPTION OF THE DRAWINGS

A detailed description of preferred embodiments of the present invention follows, with reference to the attached drawings, wherein.

DETAILED DESCRIPTION

Figure 1:
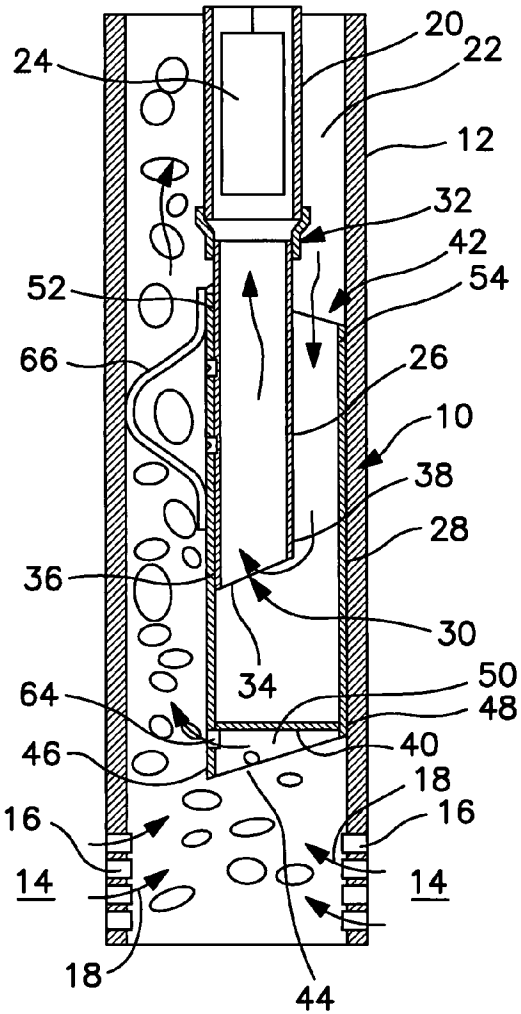
FIG. 1 is a side sectional view of one embodiment of the downhole separator of the present invention.

The invention relates to a downhole separator for downhole separation of gas from produced hydrocarbon fluids containing such gas. Referring to FIG. 1, there is illustrated a downhole separator 10 in accordance with the invention. FIG. 1 shows a fluid production well in the form of a casing 12 which is positioned into a fluid producing subterranean formation 14. Perforations 16 passing through the side wall of casing 12 allow fluids from the formation to enter casing 12 as shown by arrows 18. Within casing 12, a production tube 20 is positioned for carrying liquids from the well, and gasses are typically produced through an annular space 22 defined between casing 12 and production tube 20. A pump (schematically illustrated at 24) can be positioned within or at the end of production tube 20, and is used to lift liquids through production tube 20 to the surface.

Separator 10 according to the invention advantageously includes an internal tube 26 and an external tube 28.

Internal tube 26 is preferably a substantially cylindrical or tube shaped member having an open bottom or lower end 30, and having an upper end 32 which is connected to or communicated with production tube 20. As will be discussed further below, lower end 30 of inner tube 26 has a bottom edge 34 which is preferably sloped with respect to horizontal. Sloped bottom edge 34 defines a relatively long wall 36 and a relatively shorter wall 38, as taken with respect to length at the bottom of inner tube 26.

External tube 28 is also preferably a substantially cylindrical or tube shaped member, larger in diameter than internal tube 26, and having a closed bottom 40 and an open top 42.

External tube 28 preferably has a sidewall which extends downwardly beyond closed bottom 40 to a bottom edge 44 which is preferably sloped with respect to the horizontal so as to define a relatively longer wall 46 and a relatively shorter wall 48, as taken with respect to length at the bottom of external tube 28. This downward extension of external tube 28 serves to define a downwardly open chamber 50 which will be further discussed below.

External tube 28 also preferably has a sidewall which extends upwardly to a top edge which is preferably sloped with respect to horizontal so as to define a relatively longer wall 52 and a relatively shorter wall 54, taken with respect to upward extension at the top of external tube 28.

According to the invention, internal tube 26 is eccentrically positioned with respect to external tube 28, and external tube 28 is eccentrically positioned with respect to casing 12. This eccentric positioning serves to define liquid concentration zones within casing 12 and external tube 28 in areas which encourage liquid separation and flow through internal tube 26, and which encourage gas separation and flow through annular space 22.

Figure 2:
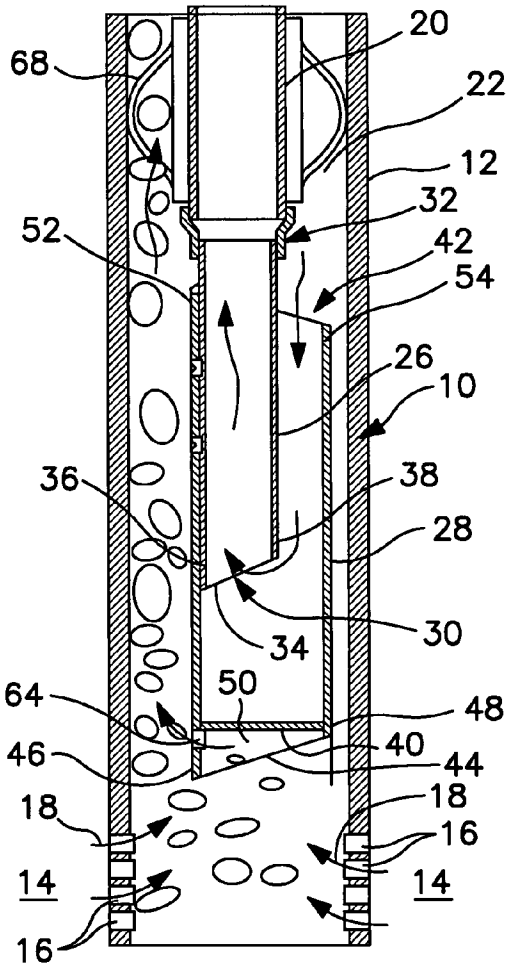
FIG. 2 is a side sectional view of an alternative embodiment downhole separator according to the invention.
Figure 3:
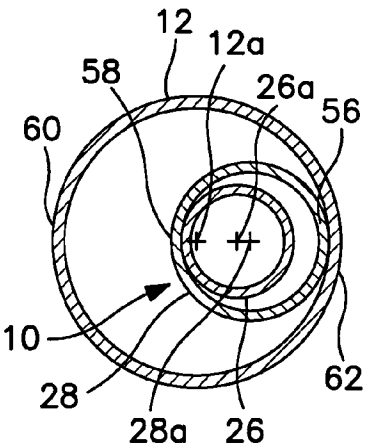
FIG. 3 is a further cross sectional view illustrating the flow profiles of the downhole separator according to the invention.

Referring also to FIG. 3, eccentric positioning of internal tube 26 within external tube 28 serves to define a crescent shaped flow area. Similarly, eccentric positioning of external tube 28 within casing 12 also serves to define a substantially crescent shaped flow area.

It has been found that gas concentration tends to be higher at the wider spacing of the walls in such a flow area, and liquid concentration tends to be greatest where the walls are closer together. It has also been found that positioning of sloped edges on internal and external tubes 26, 28 serves to influence from which side more fluid enters the tube. Based upon these findings, tubes 26, 28 are preferably positioned such that the shorter walls are facing areas where liquid concentration will be greatest, which serves to increase the effectiveness and efficiency of separator 10 according to the invention.

FIG. 3 illustrates centers 12*a*, 26*a* and 28*a* of casing 12, internal tube 26 and external tube 28 respectively. As shown, positioning of internal tube 26 serves to define a first zone 56 of external tube 28 which is relatively greater spaced from center 26*a* of internal tube 26, and a second zone 58 of external tube 28 which is relatively less spaced from center 26*a* of internal tube 26. Similarly, positioning of external tube 28 relative to casing 12 serves to define a first zone 60 of casing 12 which is relatively greater spaced from center 28*a* of external tube 28, and a second zone 62 of casing 12 which is relatively less spaced from center 28*a* of external tube 28.

According to the invention, relatively shorter wall 48 at the bottom of external tube 28 is advantageously aligned with first zone 56 of external tube 28 and second zone 62 of casing 12. This positions the area of higher liquid concentration flow from out of chamber 50 at a location where the higher liquid concentration fluid will flow upwardly and enter external tube 28 as desired.

It is appropriate at this point to further describe the function of chamber 50. Chamber 50 defined at the bottom of external tube 28 serves to collect fluid produced from formation 14 and "quiet" the flow of same so that the gas and liquid can begin to separate. A gas escape passage 64 is positioned passing through the sidewall of external tube 28, preferably at a point along relatively longer wall 46 and just below closed bottom 40. Passage 64 allows gas separated within chamber 50 escape to annular space 22 and flow upwardly through this space as desired. Relatively shorter wall 48 defines the area around the circumference of external tube through which highly concentrated liquid will first flow. Positioning this area as is shown in the drawings serves to cause more liquid to flow upwardly toward the inlet area of the upper end of external tube 28.

Still referring to FIG. 1, relatively shorter wall 54 at the upper end of external tube 28 serves to encourage fluids from this side of tube 28 to enter tube 28. Since this area is located vertically substantially above the concentrated liquid flow area generated by relatively shorter wall 48, fluid entering external tube 28 is at a greater concentration of liquid as is desired.

Fluids within external tube 28 continue to separate into gas and more concentrated liquid, with gas escaping out of the top of external tube 28 to flow upwardly through annular space 22, and with concentrated liquid flowing into the lower end of internal tube 26. The sloped bottom surface of internal tube 26 as described above further serves to enhance the flow of liquid into internal tube 26 and upwardly through production tube 20, assisted by pump 24.

In order to maintain separator 10 in the desired position with respect to casing 12, a spring member 66 is preferably positioned between external tube 28 and casing 12. In the embodiment of FIG. 1, this results in a line contact between the inner surface of casing 12 and the outer surface of external tube 28. The strength of spring 66 can preferably be selected so that proper position is maintained while no jams occur as separator 10 is being positioned through casing 12 to the proper location. Such spacers are known to a person of ordinary skill in the art in connection with centering of other types of downhole tools.

FIG. 3 illustrates an alternative embodiment of the invention wherein separator 10 has substantially the same elements as the embodiment of FIG. 1. In FIG. 3, however, proper position of separator 10 is maintained by a centering or spacing spring assembly 68 which acts upon production tube 20 as shown. In this embodiment, external tube 28 can be positioned eccentrically within casing 12 but with the walls at the first zone of external tube 28 and second zone of casing 12 being positioned close to each other without touching. Under certain circumstances, this configuration can result in greater separation efficiency, and may also be more readily deployed into the casing 12 since the spring members are on the end of the production tube 20 instead of mounted to separator 10.

Figure 4:
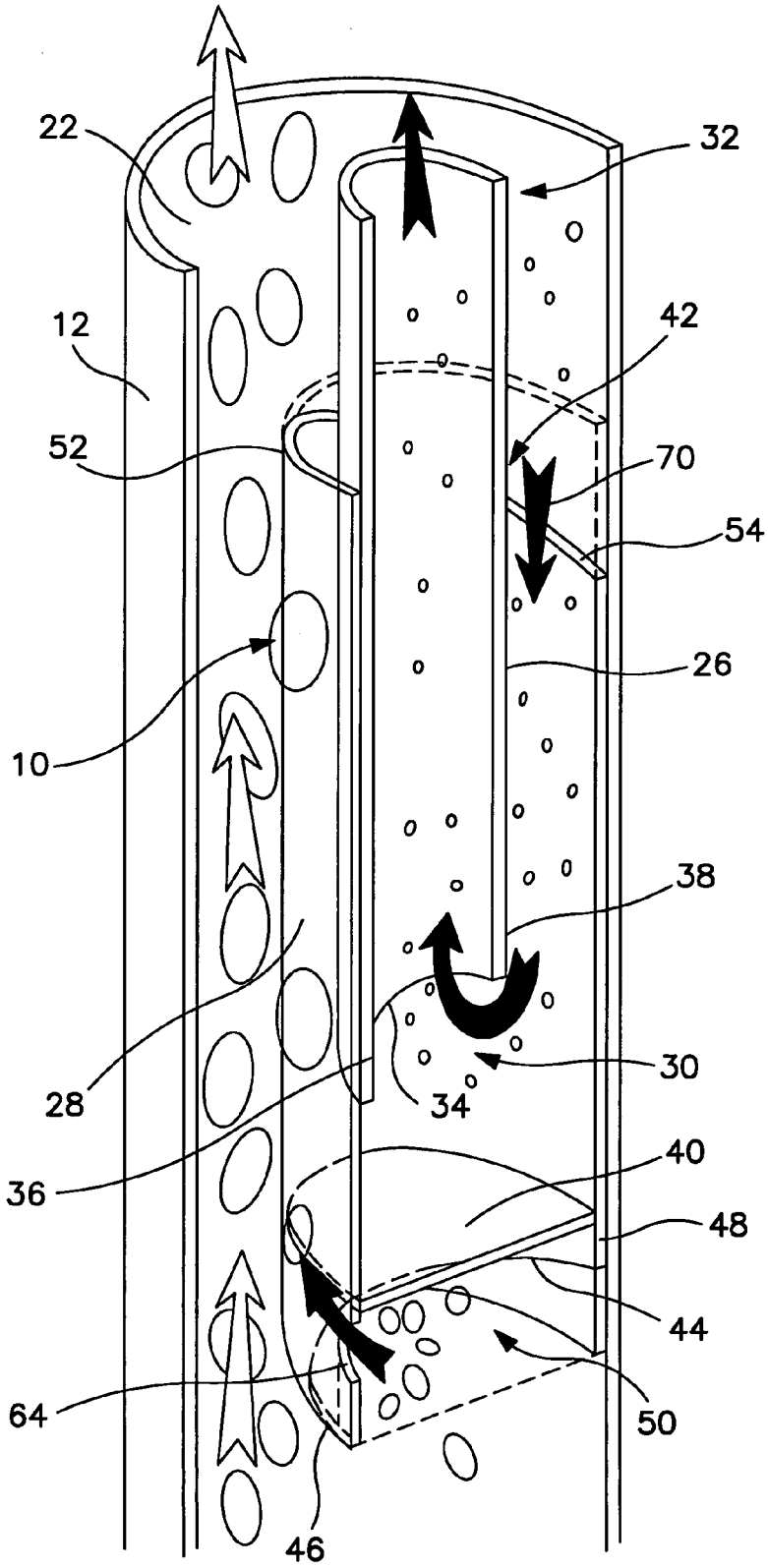
FIG. 4 is a schematic and sectional perspective view of a downhole separator according to the invention, which further shows flow of gas and liquid through the separator.

FIG. 4 provides a further illustration of separator 10 according to the invention, with additional illustration of flow during operation. The relatively dark arrows show flow of fluid which is highly liquid, while the bubbles represent separated gas. As shown, gas flows generally around chamber 50 and upwardly through the larger flow area defined between external tube 28 and casing 12. Concentrated liquid tends to flow toward the closely situated wall surfaces at the other side of casing 12, and also collects within chamber 50 and flows down and around short wall 48. This highly liquid flow of fluid flows upwardly to the top edge of external tube 28, where it enters the inner space of external tube 28 as illustrated by arrow 70. As shown, small bubbles of gas are still separating out of the flowing fluid at this stage, and can coalesce and flow upwardly through annular space 22, and/or be carried along with liquid through internal tube 26 to production tube 20. According to the invention, however, a substantial portion of gas is separated as desired and produced through annular space 22 as desired.

It should be appreciated that, when tubes 26 and 28 are referred to as being eccentrically positioned, this refers to the positioning of the tubes so that they are not concentric. Such positioning is preferably situated such that internal tube 26 is nearly touching or does touch external tube 28, and so that external tube 28 is nearly touching or does touch casing 12.

It should also be appreciated that certain parts or components of the present invention have been referred to according to their orientation, for example horizontal, vertical, sloped, etc. Each of these parameters is taken with respect to the orientation shown in the drawings, especially FIG. 1.

The mounting of internal tube 26 relative to external tube 28 can be done with welding, or bolts, or in any other manner known to a person of skill in the art.

It should be noted that internal tube 26 can alternatively be adapted for connection and communication with pump 24 instead of production tube 20. This is particularly the case where, for example, pump 24 is mounted to the bottom of production tube 20 and has a pump intake (not shown) to which internal tube 26 can be mounted.

It should be appreciated that the separator according to the invention advantageously provides for efficient separation of gas from the produced fluid in a downhole location, before the fluid enters the pump. This advantageously provides for more efficient pump operation and longer pump lifetime, as well as better fluid production rates.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

I claim:

1. A downhole gas separator, comprising:

an external tube having a closed bottom and an open top; and an internal tube positioned eccentrically within the external tube and having an open bottom and a top adapted for connection to a production tube, wherein the eccentric positioning of the internal tube relative to the external tube defines a first zone of the external tube which is relatively greater spaced from a center of the internal tube, and a second zone of the external tube which is relatively less spaced from the center, wherein the external tube has a sidewall which extends beyond the closed bottom to define a lower chamber having a bottom edge, and wherein the bottom edge is sloped to define a relatively shorter side and a relatively longer side.

2. The apparatus of claim 1, wherein the relatively shorter side of the external tube is substantially aligned with the first zone.

3. The apparatus of claim 2, wherein the internal tube has a bottom edge which is sloped to define a relatively shorter side and a relatively longer side and wherein the relatively shorter side of the internal tube is substantially aligned with the first zone.

4. The apparatus of claim 3, wherein the external tube has an upper edge which is sloped to define a relatively shorter upper side and a relatively longer upper side, and wherein the relatively shorter upper side of the external tube is substantially aligned with the first zone.

5. The apparatus of claim 1, wherein the internal tube has a bottom edge which is sloped to define a relatively shorter side and a relatively a relatively longer side and wherein the relatively shorter side of the internal tube is substantially aligned with the first zone.

6. The apparatus of claim 1, wherein the external tube has an upper edge which is sloped to define a relatively shorter upper side and a relatively longer upper side, and wherein the relatively shorter upper side of the external tube is substantially aligned with the first zone.

7. The apparatus of claim 1, wherein the external tube is mounted to the internal tube at a line of contact between an inner sidewall surface of the external tube and an outer sidewall surface of the internal tube.

8. A downhole gas separator for a production tube positioned within a casing which receives a flow of production fluid comprising gas and liquid, the separator comprising:

an external tube having a closed bottom and an open top, the external tube being positioned eccentrically within the casing; and an internal tube positioned eccentrically within the external tube and having an open bottom and a top connection to the production tube, wherein the eccentric positioning of the internal tube relative to the external tube defines a first zone of the external tube which is relatively greater spaced from a center of the internal tube, and a second zone of the external tube which is relatively less spaced from the center, wherein the eccentric positioning of the external tube relative to the casing defines a first zone of the casing which is relatively greater spaced from a center of the external tube, and a second zone of the casing which is relatively less spaced from the center, and wherein the external tube has a sidewall which extends beyond the closed bottom to define a lower chamber having a bottom edge, and wherein the bottom edge is sloped to define a relatively shorter side and a relatively longer side.

9. The apparatus of claim 8, wherein the relatively shorter side is substantially aligned with the first zone of the external tube and the second zone of the casing.

10. The apparatus of claim 9, wherein the internal tube has a bottom edge which is sloped to define a relatively shorter side and a relatively longer side and wherein the relatively shorter side is substantially aligned with the first zone of the external tube and the second zone of the casing.

11. The apparatus of claim 10, wherein the external tube has an upper edge which is sloped to define a relatively shorter upper side and a relatively longer upper side, and wherein the relatively shorter upper side is substantially aligned with the first zone of the external tube and the second zone of the casing.

12. The apparatus of claim 8, wherein the internal tube has a bottom edge which is sloped to define a relatively shorter side and a relatively longer side and wherein the relatively shorter side is substantially aligned with the first zone of the external tube and the second zone of the casing.

13. The apparatus of claim 8, wherein the external tube has an upper edge which is sloped to define a relatively shorter upper side and a relatively longer upper side, and wherein the relatively shorter upper side is substantially aligned with the first zone of the external tube and the second zone of the casing.

14. The apparatus of claim 8, wherein the external tube is mounted to the internal tube at a first line of contact between an inner sidewall surface of the external tube and an outer sidewall surface of the internal tube.

15. The apparatus of claim 14, wherein the external tube is positioned to contact the casing at a second line of contact between an outer sidewall surface of the external tube and an inner sidewall surface of the casing.

16. The apparatus of claim 15, wherein the line of contact and the further line of contact are at opposite sides of the external tube.

17. A downhole gas separator, comprising:

an external tube having a closed bottom and an open top; and an internal tube positioned eccentrically within the external tube and having an open bottom and a top adapted for connection to a production tube, wherein the eccentric positioning of the internal tube relative to the external tube defines a first zone of the external tube which is relatively greater spaced from a center of the internal tube, and wherein the internal tube has a bottom edge which is sloped to define a relatively shorter side and a relatively longer side and wherein the relatively shorter side of the internal tube is substantially aligned with the first zone.

18. A downhole gas separator for a production tube positioned within a casing which receives a flow of production fluid comprising gas and liquid, the separator comprising:

an external tube having a closed bottom and an open top, the external tube being positioned eccentrically within the casing wherein the eccentric positioning of the external tube relative to the casing defines a first zone of the casing which is relatively greater spaced from a center of the external tube, and a second zone of the casing which is relatively less spaced from the center;

an internal tube positioned eccentrically within the external tube and having an open bottom and a top connection to the production tube, wherein the eccentric positioning of the internal tube relative to the external tube defines a first zone of the external tube which is relatively greater spaced from a center of the internal tube, wherein the internal tube has a bottom edge which is sloped to define a relatively shorter side and a relatively longer side and wherein the relatively shorter side is substantially aligned with the first zone of the external tube and the second zone of the casing.

* * * * *